United States Patent [19]

Carr-Rollett

[11] 4,177,611

[45] Dec. 11, 1979

[54] SANDING AND BUFFING ATTACHMENT FOR POWER TOOLS

[76] Inventor: Derrick Carr-Rollett, 28 Abbots Way, Auckland, New Zealand

[21] Appl. No.: 909,052

[22] Filed: May 24, 1978

[51] Int. Cl.[2] ..... B24D 9/00

[52] U.S. Cl. ..... 51/376; 51/358; 51/389

[58] Field of Search ..... 51/3, 168, 170 PT, 170 T, 51/181 R, 358, 363, 366, 375, 376, 377, 378, 381, 382, 383, 384, 389, 390, 406, 372, 374, 379, 394

[56] References Cited

U.S. PATENT DOCUMENTS

| | | | |
|---|---|---|---|
| 260,336 | 6/1882 | Thayer | 51/376 |
| 732,796 | 7/1903 | Storm | 51/381 |
| 2,142,873 | 1/1939 | Krause | 51/375 |
| 2,403,813 | 7/1946 | Manderscheid | 51/168 |
| 2,426,170 | 8/1947 | Akers | 51/168 |
| 2,426,699 | 9/1947 | Luther | 51/372 |
| 2,470,282 | 5/1949 | Baker et al. | 51/168 |
| 3,287,863 | 11/1966 | Field | 51/375 |
| 3,667,169 | 6/1972 | MacKay | 51/379 |

*Primary Examiner*—Gary L. Smith
*Assistant Examiner*—Robert P. Olszewski
*Attorney, Agent, or Firm*—Holman & Stern

[57] ABSTRACT

A sanding or buffing attachment for a power tool has a cylindrical resilient base with abrasive material on its exterior. Securing plates sandwiching the base have co-operating hollow spindle portions and means for gripping the resilient base.

2 Claims, 3 Drawing Figures

SANDING AND BUFFING ATTACHMENT FOR POWER TOOLS

This invention relates to a sanding or buffing attachment for use with power tools such as for example power drills and the like.

The present invention sets out to provide a sanding or buffing attachment for use with power tools, which enables an abrasive or buffing attachment or material to be attached to a resilient base, for the purposes of being attached to a power tool and the like.

The present invention provides a resilient base to which abrasive and/or buffing material is secured or attached, the resilient base enabling the abrasive or buffing operation to be carried out to an article, regardless of the contours of the article, the resilient material enabling the abrasive or buffing material to reach into crevices and hollows of articles being sanded or buffed, in a manner hitherto not always possible.

The present invention provides a simple and straight forward construction.

Objects of the invention will become apparent from the following description.

According to one aspect of this invention there is provided a sanding or buffing attachment for power tools, including a substantially circular section of resilient material abrasive or buffing material being attachably secured to at least one outer surface thereof; securing plates being provided on inner and outer surfaces of said resilient material and having integrally formed therewith spindle sections, the spindle sections being correspondingly shaped at adjacent ends, and the arrangement being such that the plates are secured to the inner and outer surfaces of the resilient material, the spindle sections extending through the material and engaging one with the other by inter-engagement of the correspondingly shaped ends thereof; means being provided to enable the attachment to be engaged with a chuck of a power tool.

Figure 1:
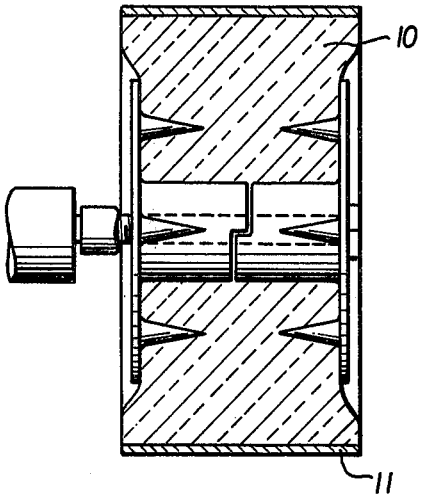
Figure 2:
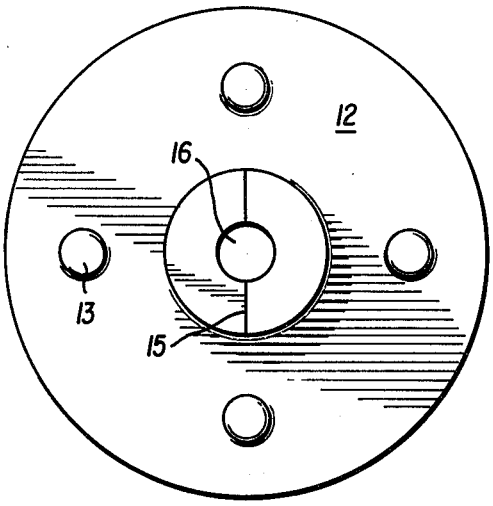

The invention will now be described by way of example and with reference to the accompanying drawings, wherein:

FIG. 1: is a sectional view of one form of sanding or buffing attachment according to the invention FIG. 2: is an end view of said one form of attachment.

Figure 3:
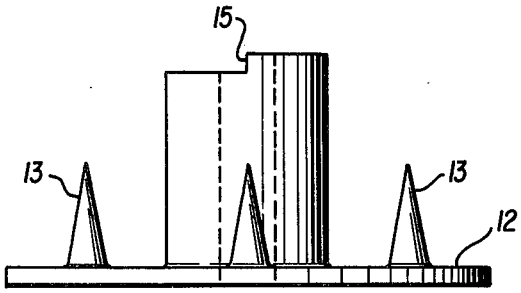

FIG. 3: is a side view of one part of the attachment.

A substantially circular section of resilient material, 10 such as foam material is provided and buffing, abrasive or other material, 11 is secured about an outer circumference thereof.

Securing end plates 12, are provided and are adapted to engage with the inner and outer surfaces of the resilient material, the plates having plate sections with inwardly depending securing or locking points 13, which are adapted to securely engage within and relative to the foam material, so as to hold the end plates in position.

The end plates have inwardly depending and integrally formed spindle sections, with shaped ends 15, and in the case of the invention shown in FIG. 1, of the accompanying drawings, are correspondingly stepped, so that the spindle sections of the plates inter-engage and lock relative to one another.

The spindle sections and plates have a bore 16, passing therethrough, to facilitate location of attachment means for attachment of the pad to a power drill, such as for example to a chuck of a power drill.

Bores passing through the spindle sections align one with the other, when the spindle sections are passed through the foam material such as by providing a bore or cut therein, so that the bore of the spindle sections aligns.

In use, the securing means to facilitate attachment of the pad to the chuck of a power drill is passed through the bore such as shown in the accompanying drawings.

It will be appreciated therefore that the end plates and ribs or points extending inwardly therefrom, engage with the foam material and if desired adhesive or some additional attachment may be provided for additional securement.

The end plates also tend to form the end circumferential surfaces outwardly, for the purposes of providing a resilient buffing or abrasive surface, or area.

The end plates may be suitably formed of any desirable material, such as for example metal, plastics or the like.

It should be appreciated that the invention has been described by way of example only and that improvements may be made without departing from the scope of the invention as defined by the appended claims.

I claim:

1. A sanding or buffing attachment for power tools including a section of resilient material having a circumferential surface, opposed inner and outer surfaces and a bore extending through said resilient material from said inner to said outer surface, abrasive or buffing material on said circumferential surface of said resilient material and a securing plate on each of said inner and outer surfaces of said resilient material, said securing plates each having a spindle section integral with the respective plate, said spindle sections extending into said bore in said resilient material, said spindle sections having stepped ends interengaging within said bore and said spindle sections further having aligned bores formed therethrough for accepting attachment means to engage the sanding or buffing attachment with a power tool chuck and said securing plates further having inwardly extending securing means engaging the resilient material and holding the plates and resilient material in position.

2. The attachment of claim 1 wherein said securing means comprises pointed members.

* * * * *